US006524023B2

(12) United States Patent
Andersen

(10) Patent No.: US 6,524,023 B2
(45) Date of Patent: Feb. 25, 2003

(54) SINGLE USE TOOTHPASTE DISPENSING DEVICES AND DISPOSIBLE TOOTHBRUSH KIT UTILIZING THE SAME

(76) Inventor: Joseph J. Andersen, 4805 Highland Ave., Downers Grove, IL (US) 60515

( * ) Notice: Subject to any disclaimer, the term of this patent is extended or adjusted under 35 U.S.C. 154(b) by 0 days.

(21) Appl. No.: 09/894,409

(22) Filed: Jun. 28, 2001

(65) Prior Publication Data

US 2003/0012594 A1 Jan. 16, 2003

(51) Int. Cl.[7] ..... A46B 11/00
(52) U.S. Cl. ..... 401/123; 401/268; 401/118; 132/308
(58) Field of Search ..... 401/123, 125, 401/268, 183, 185, 184, 118; 132/308, 311

(56) References Cited

U.S. PATENT DOCUMENTS

| | | | | | |
|---|---|---|---|---|---|
| 1,925,818 | A | * | 9/1933 | Primeau et al. | 401/123 |
| 2,167,761 | A | * | 8/1939 | Levin et al. | 401/123 |
| 2,438,641 | A | * | 3/1948 | Loehr | 401/123 |
| 2,778,045 | A | * | 1/1957 | Bly et al. | 15/131 |
| 4,503,871 | A | * | 3/1985 | Mendenhall | 401/123 |
| 5,862,817 | A | * | 1/1999 | Lee | 132/311 |
| 6,060,078 | A | * | 5/2000 | Lee | 424/440 |

* cited by examiner

*Primary Examiner*—David J. Walczak
(74) *Attorney, Agent, or Firm*—Brian R. Rayve

(57) ABSTRACT

A disposable toothbrush kit which includes a toothpaste dispensing device, and toothpaste dispensing devices for use in brushing teeth. The kit includes a disposable toothbrush and a toothpaste stick which attaches to the handle using an edible adhesive. Alternatively, a plastic toothpaste-containing vial is adhesively attached to the toothbrush.

26 Claims, 2 Drawing Sheets

SINGLE USE TOOTHPASTE DISPENSING DEVICES AND DISPOSIBLE TOOTHBRUSH KIT UTILIZING THE SAME

BACKGROUND OF THE INVENTION

1. Field of Invention

The present invention relates to the compact packaging of toothpaste and more specifically to providing small amounts of toothpaste sufficient to provide for a single brushing of the teeth.

2. Description of Related Art

Spreading of Diseases on Toothbrushes

Many diseases are transferable from one person to another orally such as by kissing, sharing of eating utensils, and sharing of toothbrushes. Disease causing bacterium and viruses, or pathogens, which cause strepp throat, gingivitis, and the common cold flourish in warn nutrient laden areas such as within the human mouth, or the oral cavity. A perfect place for transfer of such pathogens from the oral cavity of an infected person to infect another person is on the bristles of a toothbrush, and on the exposed tip of the stream of toothpaste that has come in contact with such an infected toothbrush. Should the toothpaste and nozzle become contaminated by another person's toothbrush, the next user of the toothpaste will be exposed to any pathogens originated by the previous user. This activity could be considered to be the equivalent of kissing a sick person on the lips.

Disposable Toothbrushes

Toothbrushes have been designed that can be used for a single use. These disposable toothbrushes have eliminated the need for a separate tube of toothpaste by incorporating in or on the toothbrush a sufficient amount of toothpaste.

U.S. Pat. No. 5,605,756 discloses a disposable toothbrush having a flavored toothpaste composition bonded to the bristles of the toothbrush. The process involves the chemical grafting and polymerizing of selected monomers and prepolymers to the bristles via a free radical mechanism. When the toothpaste is brought into contact with an aqueous medium, such as saliva in the oral cavity, the toothpaste dissolves thereby releasing the desired flavor to the teeth and oral cavity.

U.S. Pat. No. 5,524,764 discloses a combination adsorbent applicator, wipe for teeth and oral applicator comprising a sheath having a closed distal end and an open proximal end for receipt of a finger. An abrasive adsorbent pad is on an exterior surface and can be applied to teeth, gums, tongue, and lips for cleaning and treatment.

U.S. Pat. Nos. 5,068,941, 5,107,562, 5,213,428, and 5,287,584 are all directed to a finger toothbrush. The '562 patent and the '428 patent describe disposable finger mounted toothbrushes.

Chewable Tablets for Delivering a Medicament

In U.S. Pat. No. 6,060,078 is disclosed a chewable tablet containing a medicament in the core and a process of preparation thereof. The medicament in the core is in a jelly or chewable form. The outer layer wrapping the core comprises a gum, soft candy, or caramel. The chewable tablet is easy to take with a pleasant chewing property.

Chewable Tablets for Cleaning Teeth

In U.S. Pat. No. 5,057,305 is disclosed a tooth cleaning tablet, which tablet is such that when it is chewed in a person's mouth it forms a paste and so enables the person to effect a tooth cleaning operation as though using toothpaste.

There is a need for an improved delivery device for individual quantities of toothpaste.

SUMMARY OF INVENTION

1. Advantages of the Invention

One of the advantages of the present invention is that it eliminates multiple users of the common tube of toothpaste, providing separate individual doses of toothpaste to each person.

A further advantage of the present invention is the decrease the spread of disease between family members and toothpaste users.

These and other advantages of the present invention may be realized by reference to the remaining portions of the specification, claims, and abstract.

2. Brief Description of the Invention

The present invention comprises a disposable toothbrush kit which includes a toothpaste dispensing device, and toothpaste dispensing devices for use in brushing teeth.

The disposable toothbrush kit comprises a disposable toothbrush which includes a handle and a plurality of bristles. The handle has a brushing end from which the bristles extend generally perpendicularly to the handle, and a gripping end adapted for grasping the disposable toothbrush in-hand for brushing a person's teeth. The disposable toothbrush kit further comprises a toothpaste dispensing device which removably attaches to the handle. The toothpaste dispensing device contains a quantity of toothpaste which is dispensable therefrom sufficient for accommodating a single brushing of the person's teeth.

The toothpaste dispensing device for use in the kit and separately may comprise an elongate chewable stick which includes the toothpaste. The chewable stick attaches to the handle using an edible adhesive. The toothpaste dispensing device for use in the kit and separately may comprise an elongate sealed container which contains the toothpaste. The container has a thin outer plastic wall so as to be deformable to eject the toothpaste therefrom through an opening made through said wall onto the bristles of the disposable toothbrush prior to brushing. The toothpaste dispensing device may also comprise a chewable tablet, or a chewable toothpaste filled gelatin capsule, both typically for separate use apart from the kit, though includable with the kit.

The above description sets forth, rather broadly, the more important features of the present invention so that the detailed description of the preferred embodiment that follows may be better understood and contributions of the present invention to the art may be better appreciated. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

BRIEF DESCRIPTION OF THE DRAWINGS

Preferred embodiments of the present invention are shown in the accompanying drawings wherein.

DESCRIPTION OF THE PREFERRED EMBODIMENT

Figure 1:
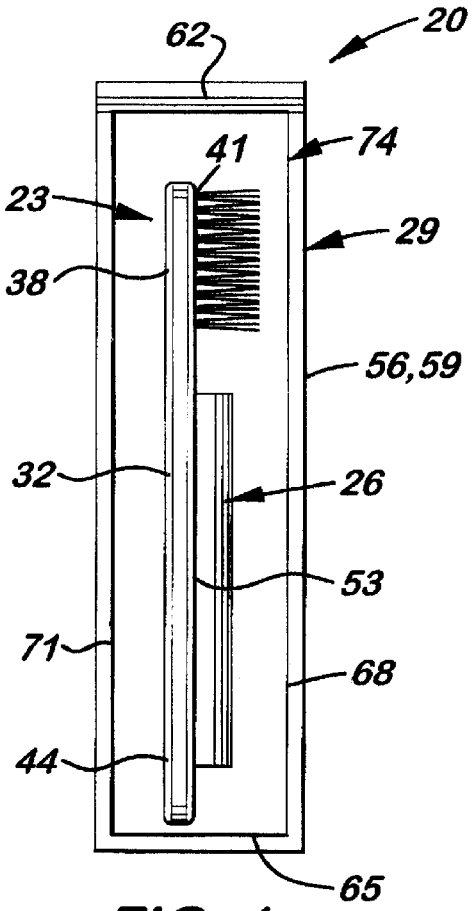
FIG. 1 is substantially a front elevational view of a prepackaged disposable toothbrush kit with a first embodiment single use toothpaste dispensing device of the invention within a cellophane packaging, the toothpaste dispensing device comprising a stick of toothpaste, being partially broken away to show the toothpaste core.

As shown in FIG. 1, a prepackaged disposable toothbrush kit of the present invention generally indicated by reference number 20, comprises a disposable toothbrush 23, and a stick type single use toothpaste dispensing device 26 of the present invention, packaged in a plastic or foil pouch or bag such as a cellophane bag 29.

Disposable Toothbrush

Figure 2:
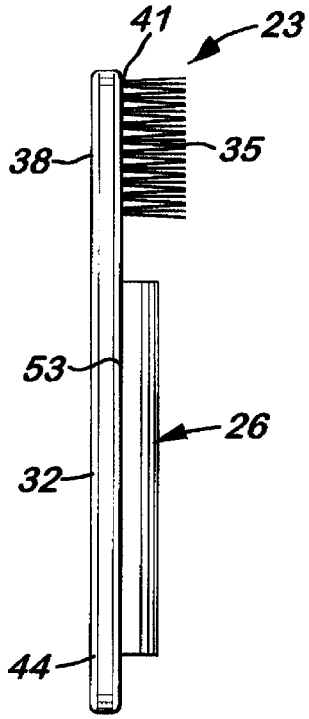
FIG. 2 is substantially a side elevational view of the disposable toothbrush with single use toothpaste dispensing device as removed from the packaging.
Figure 3:
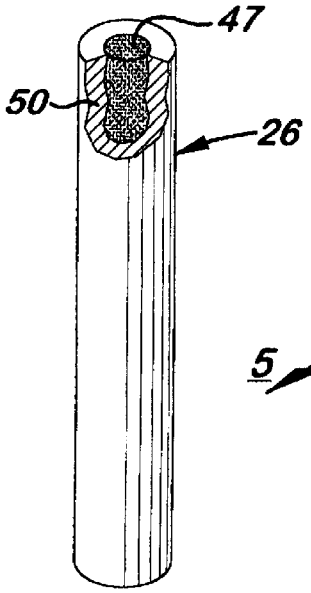
FIG. 3 is substantially a perspective view of the toothpaste dispensing device alone.

FIG. 2 shows the construction of the disposable toothbrush 23, which includes an elongate handle 32, and a plurality of bristles 35. Handle 32 is between about two to four inches in length to fit within a pants or shirt pocket (not shown), or other such convenient compartment of a person's wardrobe. Handle 32 includes a brushing end 38 having plurality of holes 41 into which the respective bristles 35 are affixed such as adhesively. Handle 32 further includes a gripping end 44 for grasping disposable toothbrush 23 in-hand for brushing a person's teeth. Handle 32 is preferably made of an inexpensive material, such as one of the many injection moldable plastics currently available. Bristles 35 are typically made of an extrudable plastic such as nylon, with handle 32 and bristles 35 also possibly being made of a biodegradable plastic or other such environmentally friendly material.

Toothpaste and Gum Stick Type Single Use Toothpaste Dispensing Device

Toothpaste dispensing device 26 comprises a soft inner core 47 surrounded by a stiffer outer layer 50.

Soft Inner Core: The soft inner core 47 is made of ingestible or edible toothpaste for cleaning the person's teeth. One suitable formula for the edible toothpaste is described in U.S. Pat. No. 3,952,867. The formula contains:

| | |
|---|---|
| insoluble sodium metaphosphate | 1200 grams |
| dicatcium phosphate | 200 grams |
| glycerin | 1160 grams |
| sodium carboxynathylcellulose | 50 grams |
| saccharin | 4 grams |
| water | 1390 grams |
| oil of spearmint | 16 grams |

Other formulations of edible toothpaste can be used as soft inner core 47. Any other flavor additive known can be added to the composition above.

Stiffer Outer Layer: Outer layer 50 can be made of toothpaste which is thickened using a thickening agent, chewing gum, or other suitable composition which stiffens toothpaste dispensing device 26 and protects the soft inner core 47. One way applicant has used to stiffen ordinary toothpaste is to heat a plurality of small quantities of the toothpaste sufficient to produce one or several toothpaste dispensing devices 26 in an oven at 400 degrees Fahrenheit for five minutes or at 1,600 degrees Fahrenheit for thirty seconds using a hot air gun. The small quantities can be in the form of a blob, a rod, or flat pieces. The small quantities provide for rapid stiffening of the toothpaste forming a stiffer outer coating for easy handling, and which can be stiffened completely therethrough by extending the heating time and/or temperature. Solid sticks or rods of stiffened toothpaste can be used alone as a chewable toothpaste dispensing device. Such stiffened toothpaste can also be used alone in the form of a stick-of-gum wrapped by foil.

Preferably outer layer 50 and inner core 47 are sugar-free so as not to promote tooth decay. Two suitable formulas for chewing gum, one with and one without sugar, as outer layer 50 are described in U.S. Pat. No. 6,060,078. The formula with sugar contains:

| | |
|---|---|
| gum base | 600 mg |
| lecithin | 9 mg |
| hydrogenated palm oil | 30 mg |
| liquid glucose | 700 mg |
| sorbitol solution | 70 mg |
| dextrose | 340 mg |
| sugar | 940 mg |
| aspartame | 10 mg |
| glycerin | q.s. |
| flavoring agent | q.s. |

The formula without sugar contains:

| | |
|---|---|
| gum base | 200 mg |
| lecithin | 12 mg |
| isomalt | 415 mg |
| aspartame | q.s. |
| flavoring agent | q.s. |

Soft inner core 47 and stiffer outer layer 50 are co-extruded and cut to the desired length to provide individual toothpaste dispensing devices 26.

Attachment of the Toothpaste Dispensing Device

Toothpaste dispensing device 26 is attached to toothbrush 23 using an edible adhesive 53 such that when toothpaste dispensing device 26 is forcibly removed from toothbrush 23, by hand, any remaining adhesive 53 on toothpaste dispensing device 26 after removal will not harm the person by eating. One suitable formula for the edible adhesive is described in U.S. Pat. No. 5,827,553 which is oil-free and fat-free.

The edible adhesive comprises from about 3% to about 60% of a starch hydrolysate having a dextrose equivalent of from about 4 to about 38; from about 3% to about 80% of alcohol having 1 to 4 hydroxyl groups and 2 to 4 carbon atoms; from about 0% to about 50% polymerized glycol having a molecular weight of about 200 to 9,500; and a solvent comprising from about 5% to about 35% water. Optionally, an acidulant such as citric acid or anhydrous citric acid is used as an antimicrobial agent. Preservatives such as potassium sorbate can be used. Edible colorants can be used. Sorbitol, and other sugar alcohols and other sweeteners are added where sweet food is desired. The edible adhesive can be applied by spraying or brushing.

Cellophane Bag Packaging

Cellophane bag 29 acts as an airtight container to keep the toothpaste dispensing device 26 attached to disposable toothbrush 23 as fresh as possible providing a longer shelf life. Bag 29 is made of dual sheets of cellophane 56 and 59, which are heat sealed together at respective top and bottom seams 62 and 65, and at respective side seams 68 and 71. A V-notch 74 below top seam 62, along with the use of the relatively tearable cellophane material allow easy opening of bag 29 by tearing at the V-notch 74.

The prepackaged disposable toothbrush kit 20 eliminates the need for a complex inexpensive article that is intended to be used only once. In eliminates, when traveling, the need for packing both a toothbrush and a tube of toothpaste.

Using the Disposable Toothbrush Kit

The disposable toothbrush kit 20 is used by opening cellophane bag 29 at V-notch 74 and removing the disposable toothbrush 23 with attached toothpaste dispensing device 26. Toothpaste dispensing device 26 is removed from disposable toothbrush 23 by applying hand pressure until the edible adhesive 53 fractures. Toothpaste dispensing device 26 is placed in the user's mouth and chewed to release the toothpaste of soft inner core 47. The outer layer 50, if made of chewing gum, forms a chewable gum ball which is spit out prior to brushing the teeth using the disposable toothbrush 23. If outer layer 50 is made of toothpaste, then the entire toothpaste dispensing device 26 including any residual edible adhesive 53 dissolves in the user's mouth and brushing can commence.

Vial Type Single Use Toothpaste Dispensing Device

Figure 4:
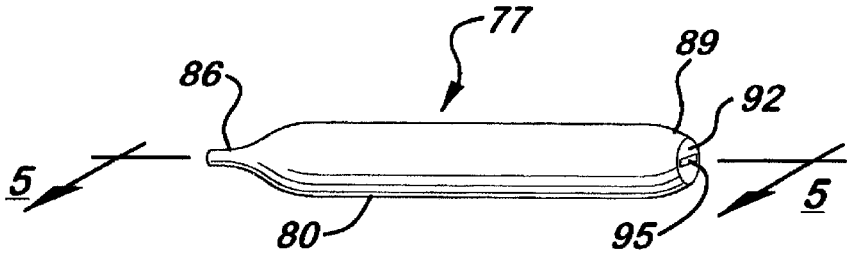
FIG. 4 is substantially a perspective view of a second embodiment toothpaste dispensing device of the invention comprising a disposable flexible vial filled with toothpaste for use with the prepackaged disposable toothbrush.
Figure 5:
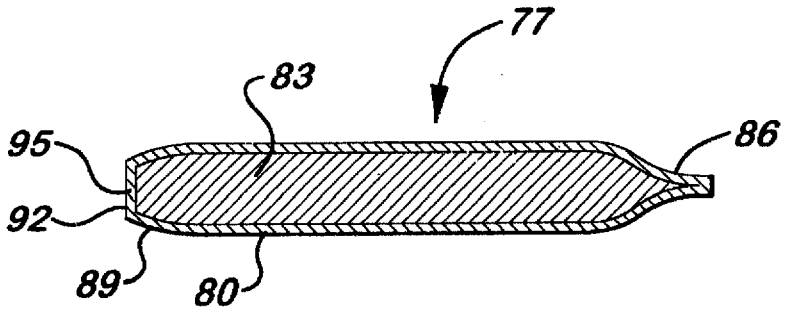
FIG. 5 is substantially a longitudinal vertical sectional view taken on the line 5—5 of FIG. 4 showing the construction of the vial.

Referring to FIGS. 4 and 5, a toothpaste dispensing device 77 can replace toothpaste dispensing device 26 in prepackaged disposable toothbrush kit 20. Toothpaste dispensing device 77 is in the form of a plastic vial 80 filled with toothpaste 83. The toothpaste dispensing device 26 is preferably of a cross-sectional area generally approximating a corresponding cross-sectional area of the handle 32. Vial 80 is disposable once the toothpaste 83 contained therein has been removed, being made of thin plastic so as to be deformable to eject the toothpaste 83 therefrom. Vial 80 has a heat sealed back end 86 into which toothpaste 83 is introduced to initially fill vial 80 prior to heat sealing. A front end 89 of vial 80 is tapered and terminates at a flat face 92 having a weakening perforation 95, which extends partially through the thickness of flat face 92. When vial 80 is squeezed sufficiently hard at front end 89, weakening perforation 95 splits to allow the toothpaste 83 to be discharged onto the bristles 35 of disposable toothbrush 23 for brushing.

Gum Tablet Type Single Use Toothpaste Dispensing Device

Figure 6:
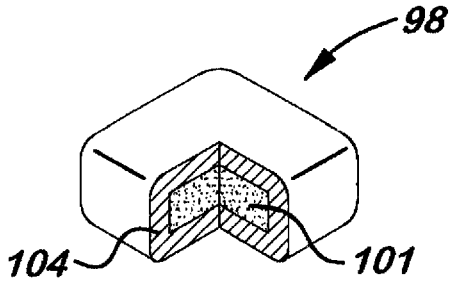
FIG. 6 is substantially a perspective view of a third embodiment toothpaste dispensing device of the invention comprising a toothpaste filled gum tablet, being partially broken away to show the toothpaste core.

As shown in FIG. 6, a toothpaste filled gum tablet 98 comprises a soft inner core 101 surrounded by a stiffer outer layer 104. The soft inner core 101 is made of the ingestible or edible toothpaste as described for soft inner core 47 of toothpaste dispensing device 26. Outer layer 104 can be made of toothpaste which is thickened, chewing gum, or other suitable composition as described for toothpaste dispensing device 26. Preferably outer layer 104 and inner core 101 are sugar-free so as not to promote tooth decay.

Using the Gum Tablet Type Single Use Toothpaste Dispensing Device

The toothpaste filled gum tablet 98 is used by placing in the user's mouth and chewing to release the toothpaste of soft inner core 101. The outer layer 104, if made of chewing gum, forms a chewable gum ball which is spit out prior to brushing using a toothbrush such as the disposable toothbrush 23. If outer layer 104 is made of toothpaste, then the entire toothpaste filled gum tablet 98 dissolves in the user's mouth and brushing can commence.

Gelatin Capsule Type Single Use Toothpaste Dispensing Device

Figure 7:
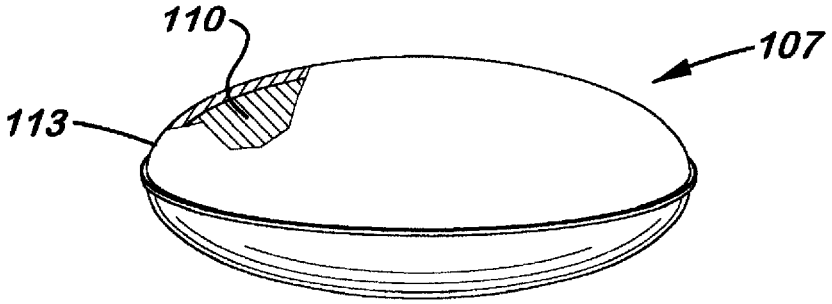
FIG. 7 is substantially a perspective view of a fourth embodiment toothpaste dispensing device of the invention comprising a toothpaste filled gel capsule, being partially broken away to show the toothpaste filling.

As shown in FIG. 7, a toothpaste filled gelatin capsule 107 comprises toothpaste 110 encapsulated by an outer gelatin shell 113. The toothpaste 110 can be the same ingestible or edible toothpaste as described for soft inner core 47 of toothpaste dispensing device 26. The outer gelatin shell 113 can be made of any of the various types of covering and techniques known in industry for encapsulation. The use of gelatin capsules which are impervious to aqueous solutions containing less than 10% water, but which will readily dissolve in a liquid environment such as in a person's mouth are useful. The toothpaste 110 may be fed into the outer gelatin shell 113 or a pre-measured amount of toothpaste 110 may be covered with a thin coating of gelatin or a similarly edible coating material. Preferably, the entire toothpaste filled gelatin capsule 107 is sugar-free so as not to promote tooth decay.

Conclusion

It can now be seen that the present invention solves many of the problems associated with the prior art. The invention provides separate individual doses of toothpaste to each person, eliminating multiple users of the common tube of toothpaste. The invention provides for decrease in the spread of disease to the users of the invention and to others with whom the user has contact such as family members and other toothpaste users in the home. Also, the invention decreases the spread of disease in community facilities such as the common lavatory counters used in dormitories, at camp grounds, in oral surgery facilities, etc. This is particularly important when the user of the invention or others in contact with the user have a compromised immune system. The invention is also effective in reducing the spread of viruses such as herpes.

Although the description above contains many specifications, these should not be construed as limiting the scope of the invention but as merely providing illustrations of some of presently preferred embodiments of this invention. The specification, for instance, makes reference to toothpaste. It should be understood that most any type of most any toothpaste can be used including that of the gel variety. The specification also makes reference to small, disposable toothbrushes such as used in the kit. However, the present invention is not intended to be limited to use with small disposable toothbrushes. Rather it is intended that the present invention can be used with most any type of toothbrush, including the full-size variety, and using other types of disposable toothbrushes in the kit. Thus, the scope of the invention should be determined by the appended claims and their legal equivalents rather than by the examples given.

What is claimed is:

1. A disposable toothbrush, comprising:

a disposable toothbrush which includes a handle and a plurality of bristles, said handle having a brushing end from which said bristles extend generally perpendicularly to said handle and a gripping end adapted for grasping the disposable toothbrush in-hand for brushing a person's teeth;

a toothpaste dispensing device which is removably attached to said handle using an adhesive, said toothpaste dispensing device containing a quantity of toothpaste which is dispensable therefrom sufficient for accommodating a single brushing of a person's teeth; and wherein said toothpaste dispensing device comprises an elongate chewable stick which includes said toothpaste, and wherein the adhesive which attaches the stick to the handle comprises an edible adhesive.

2. The disposable toothbrush kit of claim 1, wherein the handle is between about two to four inches in length so as to fit within a shirt pocket.

3. The disposable toothbrush kit of claim 1, wherein the toothbrush and the toothpaste dispensing device are packaged in a sealed pouch which includes at least one tearing notch to facilitate opening said pouch by hand.

4. The disposable toothbrush kit of claim 1, wherein the chewable stick comprises toothpaste which includes a thickening agent providing for rigidity of said chewable stick.

5. The disposable toothbrush kit of claim 1, wherein the chewable stick comprises a generally soft inner core supported by a stiffer outer layer.

6. The disposable toothbrush kit of claim 5, wherein the inner core comprises toothpaste.

7. The disposable toothbrush kit of claim 6, wherein the toothpaste comprises an edible toothpaste.

8. The disposable toothbrush kit of claim 6, wherein the outer layer comprises chewing gum.

9. The disposable toothbrush kit of claim 1, wherein the chewable stick is sugar-free so as not to promote tooth decay.

10. The disposable toothbrush kit of claim 1, wherein toothpaste dispensing device is of a cross-sectional area generally approximating a corresponding cross-sectional area of the handle.

11. The disposable toothbrush kit, comprising:

a disposable toothbrush which includes a handle and a plurality of bristles, said handle having a brushing end from which said bristles extend generally perpendicularly to said handle and a gripping end adapted for grasping the disposable toothbrush in-hand for brushing a person's teeth;

a toothpaste dispensing device comprising a chewable member which includes toothpaste that removably attaches to said handle, said toothpaste dispensing device containing a quantity of said toothpaste which is dispensable therefrom sufficient for accommodating a single brushing of a person's teeth; and wherein said toothpaste dispensing device is adhesively attached directly externally to said handle using an edible adhesive adapted for subsequent separation upon application of a sufficient hand force.

12. The toothpaste dispensing device of claim 11, wherein the chewable member comprises a chewable tablet.

13. The toothpaste dispensing device of claim 12, wherein the chewable tablet comprises toothpaste which includes a thickening agent providing for rigidity of said chewable tablet.

14. The toothpaste dispensing device of claim 12, wherein the chewable tablet comprises a generally soft inner core supported by a stiffer outer layer.

15. The toothpaste dispensing device of claim 14, wherein the inner core comprises toothpaste.

16. The toothpaste dispensing device of claim 15, wherein the outer layer comprises chewing gum.

17. The toothpaste dispensing device of claim 11, wherein the chewable member is sugar-free so as not to promote tooth decay.

18. The toothpaste dispensing device of claim 11, wherein the toothpaste comprises an edible toothpaste.

19. The toothpaste dispensing device of claim 11, wherein the chewable member comprises a chewable stick.

20. The toothpaste dispensing device of claim 19, wherein the chewable stick comprises toothpaste which includes a thickening agent providing for rigidity of said chewable stick.

21. The toothpaste dispensing device of claim 19, wherein the chewable stick comprises a generally soft inner core supported by a stiffer outer layer.

22. The toothpaste dispensing device of claim 21, wherein the inner core comprises toothpaste.

23. The toothpaste dispensing device of claim 22, wherein the outer layer comprises chewing gum.

24. The toothpaste dispensing device of claim 11, wherein the chewable member comprises a chewable toothpaste filled gelatin capsule.

25. The toothpaste dispensing device of claim 24, wherein the toothpaste comprises an edible toothpaste.

26. The toothpaste dispensing device of claim 24, wherein the gelatin shell is impervious to aqueous solutions containing less than 10% water, but which will readily dissolve in a liquid environment such as in a person's mouth.

* * * * *